US007025349B1

(12) United States Patent
Ford et al.

(10) Patent No.: US 7,025,349 B1
(45) Date of Patent: Apr. 11, 2006

(54) MAIL LOCATION APPARATUS

(75) Inventors: Thomas David Reid Ford, Royston (GB); Piers Harding, Alconbury Weston (GB)

(73) Assignee: Neopost Limited, Romford (GB)

( * ) Notice: Subject to any disclaimer, the term of this patent is extended or adjusted under 35 U.S.C. 154(b) by 456 days.

(21) Appl. No.: 09/493,652

(22) Filed: Jan. 28, 2000

(30) Foreign Application Priority Data

Jan. 29, 1999 (GB) ..... 9902062

(51) Int. Cl.
*B65H 7/14* (2006.01)

(52) U.S. Cl. ..... 271/265.01; 271/2; 271/152; 101/91

(58) Field of Classification Search ..... 271/2, 271/152, 265.01, 258, 170; 227/2, 5, 6, 7; 101/91, 71, DIG. 30, 93.06, 474, 485, 35; 235/101
See application file for complete search history.

(56) References Cited

U.S. PATENT DOCUMENTS 3,948,170 A * 4/1976 Ericsson ..... 101/124
4,516,494 A * 5/1985 Beck et al. ..... 101/91
4,742,771 A * 5/1988 Heilig ..... 101/407
4,831,273 A 5/1989 Ross et al.
5,640,903 A * 6/1997 Salomon ..... 271/265.01 X
5,914,464 A * 6/1999 Vogel ..... 177/145
6,408,744 B1 * 6/2002 Viennet et al. ..... 101/91

OTHER PUBLICATIONS

Printout of webpage http://dictionary.cambridge.org/define.asp?key=normal*1+0, The Cambridge Dictionaries Online—Definition of normally, Cambridge University Press, 2002, Jan. 30, 2003.*
Search Report Under Section 17.

* cited by examiner

*Primary Examiner*—Patrick Mackey
(74) *Attorney, Agent, or Firm*—Shoemaker and Mattare

(57) ABSTRACT

Mail location apparatus for a postal meter is disclosed in which a required location of a mail piece to receive a postal indicium imprint is defined by guide walls which are engaged by adjacent edges of the mail piece when the mail piece is in the required location. A sensor is provided to provide an indication when the mail piece is in the required location. The sensor includes a sensor element having a face inclined to both guide walls. When a mail piece is inserted, a corner of the mail piece between the two edges of the mail piece engages the face of the sensor element and displaces the sensor element to output an electrical signal when the mail piece is in the required location with the edges thereof engaging the guide walls.

12 Claims, 1 Drawing Sheet

MAIL LOCATION APPARATUS

BACKGROUND OF THE INVENTION

This invention relates to the detection of mail and in particular to detection that a mail item is correctly positioned to receive a postage imprint.

Postal authorities require that postal indicia are printed in a specified position in the upper right hand corner of mail items. Accordingly, in printing devices for printing postal indicia on mail items, it is necessary that the mail item be correctly positioned relative to a print head to ensure that the postal indicia is printed in the specified position on the mail item. In postage meter printing devices in which the mail item is fed along a feed bed by a mail transport mechanism, the mail item is inserted with an upper edge thereof in engagement with a guide and the transport mechanism then feeds the mail item while maintaining the upper edge of the item in engagement with the guide. When a leading edge of the mail item is sensed by a sensor, printing of the postal indicia is initiated. The position of the guide relative to the print head determines the spacing of the printed indicium from the upper edge of the mail item and the position of the sensor determines the spacing of the indicium from the leading right hand edge of the mail item. Thus it will be appreciated that the sensor is required only to detect movement of the mail in one direction, namely the direction in which the mail item is fed by the transport mechanism.

In postage metering apparatus intended to handle a smaller number of mail items, the mail item transport mechanism is dispensed with and the mail item is inserted into the apparatus and must be correctly positioned manually. Accordingly it is necessary to provide mail detection means capable of ensuring that the mail is correctly positioned is mutually perpendicular directions prior to initiation of printing of the postal indicium.

SUMMARY OF THE INVENTION

According to the invention a mail location apparatus operative to locate a mail item at a predetermined location in first and second mutually perpendicular directions includes a first guide for engagement by a first edge of a mail item; a second guide for engagement by a second edge of the mail item; said second edge being adjacent to and adjoining said first edge at a corner of the mail item; sensor means including a face engageable by said corner of the mail item; said face being inclined to both said first and second directions; said sensor means being operated in response to the mail item being located in said predetermined location.

BRIEF DESCRIPTION OF THE DRAWING

An embodiment of the invention will now be described by way of example with reference to the drawings in which:—

DESCRIPTION OF THE PREFERRED EMBODIMENT

Figure 1:
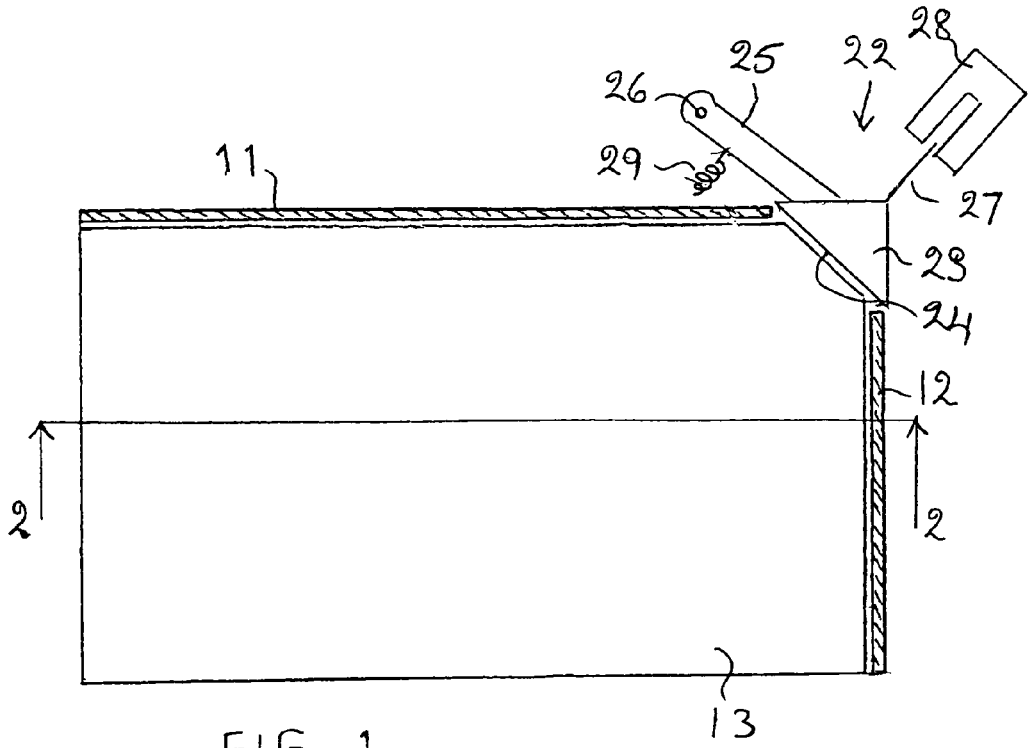
FIG. 1 is sectional view of a mail receptor and sensor of a postage meter on a line 1—1 of FIG. 2.

Referring to the drawings, a mail receptor includes an upper wall 10 from which a rear wall 11 and a side wall 12 extend. A mail support platform 13 extends below the upper wall 10 and is movable between open and closed positions.

Figure 2:
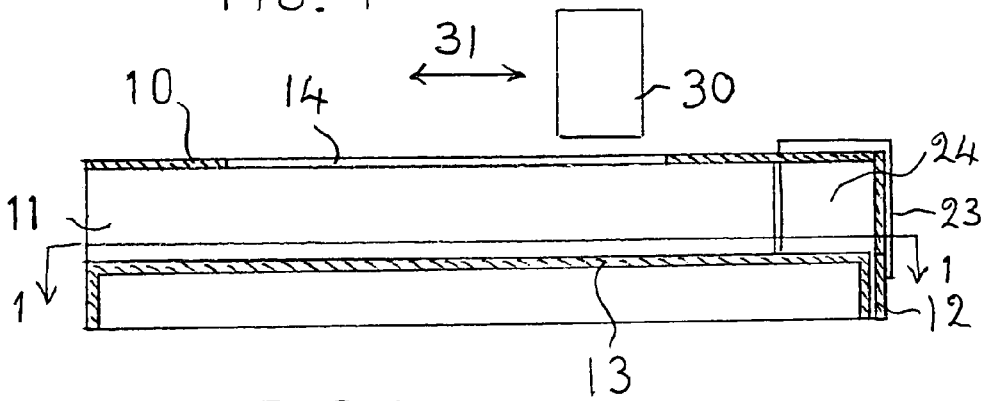
FIG. 2 is a section on the line 2—2 of FIG. 1.

In the open position as shown in FIG. 2 the platform is in a lowermost position spaced from the upper wall 10 to permit the entry into the mail receptor of a mail item to receive an imprint and to permit the removal of the mail item from the mail receptor after receiving the imprint. In the closed position, the platform is urged toward the upper wall 10 so that a mail item in the receptor is pressed by the platform against the upper wall 10 and clamped between the platform and the upper wall. Preferably the platform is urged toward the closed position by compression springs and is moved to the open position by a mechanism operated by the postage meter.

Figure 3:
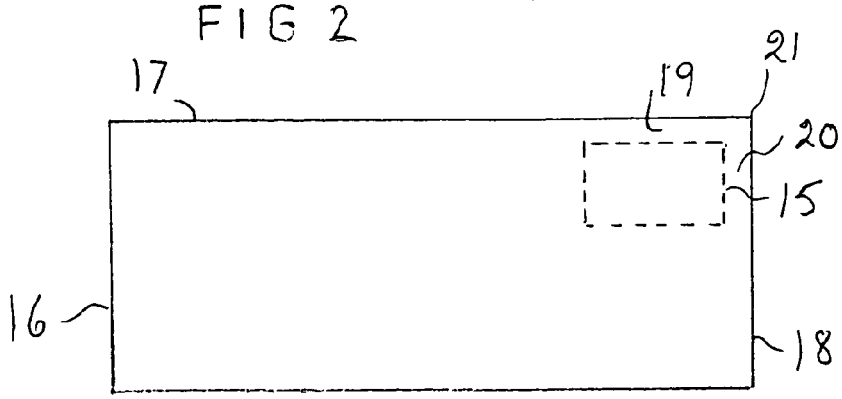
FIG. 3 illustrates a mail item and a print field thereon.

The upper wall 10 has an aperture 14 therein so that, when a mail item is correctly positioned in the mail receptor, a print field 15 of a mail item 16, see FIG. 3, is aligned with the aperture and hence is exposed for receiving an imprint from an ink jet print head, indicated at 30. During printing of the imprint, the mail item is held by being clamped between the platform 13 and the upper wall 10 and hence the surface of the mail item to receive the imprint is located in a plane determined by the wall 10. The print head is traversed in the direction of arrow 31 across the aperture to print a required postal indicium imprint in the print field of the mail item.

When a mail item is inserted into the mail receptor, an upper edge 17 of the mail item lies adjacent the rear wall 11 and a right edge 18 of the mail item lies adjacent the side wall 12.

Postal authorities specify the location of the print field 15 in which a postal indicium is to be printed on a mail item. The location of the postal indicium is specified as a distance 19 from the upper edge 17 and a distance 20 from the right hand edge 18. Accordingly the rear wall 11 is located relative to the traverse of the print head such that when the upper wall 17 of the mail item is located in engagement with the rear wall 11, the print head prints the indicium with the required spacing 19 from the upper edge of mail item. The operation of the print head during its traverse of the aperture 14 is timed such that with the right hand edge 18 of the mail item located in engagement with the side wall 12, the print head prints the indicium with the required spacing 20 from the right hand edge 18 of the mail item.

An ink jet printer mechanism including a mechanism for moving a mail support platform is described in co-pending application filed on the same date as the present application and entitled INK JET PRINTER MECHANISM.

In order that the postal indicium is printed in the specified print field of the mail item, it is necessary to ensure during the printing of the indicium the mail item that the mail item is correctly located in the receptor with the upper edge 17 in engagement with the rear wall and with the right hand edge 18 in engagement with the side wall 12. This required location of the mail item in the receptor can be determined by detecting that a corner 21 of the mail item at the intersection of the upper edge 17 and the right edge 18 is located at an imaginary intersection between the rear wall 11 and the side wall 12 of the receptor.

The rear wall 11 and the side wall 12 do not extend as far as the imaginary intersection therebetween and a mail sensor indicated generally by the reference numeral 22 is located adjacent this imaginary intersection. The sensor includes an element 23 having a face 24 inclined to both the rear wall 11 and the side wall 12. A corner portion of the upper wall 10 and of the platform 13 is omitted and the element extends at least to beyond the upper wall 10 and to at least beyond the mail engaging surface of the support platform 13 when in the open position. The element 23 is mounted on a lever 25 pivoted at 26 and is resiliently urged by a spring 29 into the position of the element 23 shown in FIG. 1. A shutter 27 secured relative to the element 23 extends into operative relationship with an electro-optic device 28. With the element 23 resiliently urged into the position shown in FIG. 1, the face 24 thereof extends across a corner of the mail receptor and the shutter is in a withdrawn position relative to the electro-optic device 28. When a mail item is inserted into the mail receptor to an extent such that the upper edge 17 is located in engagement with the rear wall 11 and the right hand edge 18 is located in engagement with the sidewall 12, the corner 21 engages the face 24 of the element 23 and displaces the element against the force of spring 29 and hence the shutter enters the electro-optic device and interrupts a radiation path between an emitter and a photocell to thereby produced an electrical sensing output signal. The output signal is then utilised to initiate movement of the platform to clamp the mail item in the required correct position and after clamping of the mail item the printing operation is initiated to print the postal indicium on the mail item.

It will be appreciated that mail items may have a range of dimensions and the hence the mail receptor is open for receipt of mail either from a front of the receptor opposite the rear wall or from a side of the receptor opposed to the side wall 12 and when the upper right hand part of the mail item containing the print field 15 is located in the receptor, a remainder of the mail item extends away from the walls 11 and 12 beyond the extent of the upper wall and platform. Accordingly when a mail item is inserted manually into the receptor, the item may be moved in a first direction aligned with the side wall 12, in a second direction aligned with the rear wall 11 or in a direction intermediate the first and second directions.

The rear wall 10 and the side wall 12 act as guides for the mail items during manual entry of the mail item into the mail receptor. The walls also define locations at which the upper and right hand edges of the mail item must located for the mail item to be correctly positioned for receipt of the postal indicium imprint. Furthermore it will be appreciated that regardless of the direction of entry of the mail item, the sensor will be operated by engagement of the corner 21 of the mail item only when the mail item is correctly located with the edges 17, 18 thereof in engagement with the walls 11 and 12 respectively. Furthermore because the face 24 is inclined to both the rear wall 11 and to the side wall 12 movement of the mail item to the required correct position in the first direction aligned with the rear wall, in the second direction aligned with the side wall or in any direction intermediate the first and second directions will result in operation of the sensor 22. It is preferred that the face 24 is inclined at approximately the same angle to both the rear and side walls and hence that the face is inclined to the walls at an angle of approximately 45°.

If the element 23 only extended as far as the upper wall 10 there is a possibility that very thin mail items may enter a gap between the element and the wall and become jammed. Accordingly, as described hereinbefore the face 24 of the sensor element 23 extends beyond the wall 10 and beyond the surface of the platform when in its open position to prevent the occurrence of such a jam.

We claim:

1. Mail location apparatus operative to locate a mail item inserted thereinto at a predetermined location in first and second mutually perpendicular directions, including:

a first guide for engagement by a first edge of the mail item;

a second guide for engagement by a second edge of the mail item, the second edge being adjacent to and adjoining the first edge at a corner of the mail item; and a sensor unit operative in response to the mail item being located in the predetermined location with the first edge engaging the first guide and the second edge engaging the second guide, the sensor unit including an elongate face engageable by the mail item, which face is inclined to both the first and second directions such as to be engaged by the corner of the mail item whether the mail item is inserted in the first direction, the second direction and any direction intermediate thereto, wherein the face of the sensor unit is inclined at approximately 45 degrees to the first and second directions.

2. Mail location apparatus as claimed in claim 1, wherein the first guide comprises a first guide wall extending lengthwise in the first direction, the second guide comprises a second guide wall extending lengthwise in the second direction, and the first and second guide walls define the predetermined location.

3. Mail location apparatus as claimed in claim 2, wherein adjacent ends of the first and second guide walls are spaced apart and the face of the sensor unit normally is located to extend between the adjacent ends of the first and second guide walls across a corner of the predetermined location.

4. Mail location apparatus as claimed in claim 3, wherein the sensor unit is responsive to displacement of the face thereof out of the predetermined location.

5. Mail location apparatus as claimed in claim 3, wherein the sensor unit includes an element defining the face engageable by the corner of the mail item, the element being displaceable in a direction inclined to both the first guide wall and the second guide wall by insertion of the mail item into the predetermined location.

6. Mail location apparatus as claimed in claim 5, wherein the element is mounted on a pivot.

7. Mail location apparatus as claimed in claim 5, wherein the sensor unit includes a resilient member operative to urge the element to a location in which the face thereof extends across the corner of the predetermined location.

8. Mail location apparatus as claimed in claim 5, wherein the sensor unit includes a detector responsive to displacement of the element to a position in which the face thereof does not extend across the corner of the predetermined location.

9. Mail location apparatus as claimed in claim 1, further comprising: a support platform for supporting the mail item located in the predetermined location; and a reference wall for referencing the mail item located in the predetermined location; wherein the face of the sensor unit extends at least beyond the support platform and the reference wall.

10. Mail location apparatus as claimed in claim 9, wherein the first and second guide walls extend from the reference wall, and the support platform is displaceable between an open position in which the mail item can be inserted into the predetermined location between the reference wall and the support platform and a closed position in which the mail item located in the predetermined location is held by the reference wall and the support platform.

11. Mail location apparatus as claimed in claim 10 in combination with a print head, wherein the reference wall has an aperture therein, and the print head is selectively operable to print a postal indicium through the aperture in the reference wall onto the mail item located in the predetermined location.

12. Mail location apparatus operative to locate a mail item at a predetermined location in first and second mutually perpendicular directions, including:

a first guide for engagement by a first edge of the mail item;

a second guide for engagement by a second edge of the mail item, the second edge being adjacent to and adjoining the first edge at a corner of the mail item; and a sensor unit operative in response to the mail item being located in the predetermined location with the first edge engaging the first guide and the second edge engaging the second guide, the sensor unit including a face inclined to both the first and second directions and engageable by the corner of the mail item, the face being normally located to extend from adjacent ends of the first and second guides across a corner of the predetermined location.

* * * * *